US005222450A

United States Patent [19]

Ackermann

[11] Patent Number: 5,222,450

[45] Date of Patent: Jun. 29, 1993

[54] LAP SEAMER DEVICE FOR SEWING MACHINE

[75] Inventor: Manfred Ackermann, Elmhurst, Ill.

[73] Assignee: Union Special Corporation, Chicago, Ill.

[21] Appl. No.: 757,558

[22] Filed: Sep. 11, 1991

[51] Int. Cl.[5] ..... D05B 29/00; D05B 35/02

[52] U.S. Cl. ..... 112/142; 112/235; 112/151

[58] Field of Search ..... 112/142, 235, 122, 151

[56] References Cited

U.S. PATENT DOCUMENTS

| | | | |
|---|---|---|---|
| 2,915,996 | 12/1959 | Charest | 112/151 X |
| 3,096,735 | 7/1963 | Wise | 112/151 |
| 3,257,979 | 6/1966 | Michaud | 112/235 X |
| 3,370,559 | 2/1968 | Longcore | 112/151 X |
| 4,321,880 | 3/1982 | Boser | 112/235 X |
| 4,526,113 | 7/1985 | Angele | 112/235 X |

FOREIGN PATENT DOCUMENTS

| | | | |
|---|---|---|---|
| 3618462A1 | 12/1987 | Fed. Rep. of Germany . | |
| 1586901 | 3/1981 | United Kingdom | 112/151 |

OTHER PUBLICATIONS

Union Special Corporation Catalog No. T118H, Apr., 1980.

*Primary Examiner*—Clifford D. Crowder
*Assistant Examiner*—Paul C. Lewis
*Attorney, Agent, or Firm*—Willian Brinks Olds Hofer Gilson & Lione

[57] ABSTRACT

A device for sewing together two plies of cloth with a lap seam. The device comprises a cloth guide that is disposed between a plurality of reciprocating needles and the front of a cutting knife. The guiding portion of the cloth guide extends substantially between the needles and the front edge of the cutting knife. A cloth guide for assuring a full lap of material when sewing a lap seam where the left ply is to be laid on top of the right ply is also provided.

2 Claims, 3 Drawing Sheets

LAP SEAMER DEVICE FOR SEWING MACHINE

BACKGROUND OF THE INVENTION

The invention relates to sewing machines, and specifically to sewing machines that perform a lap seam stitch.

A lap seam is generally sewn on a feed-off-the-arm sewing machine, and is used to join two plies of material that are positioned on top of one another. In one method, the plies are presented to the machine with the ends turned up. The machine trims the ends, folds the trimmed ends down on top of one another and sews the lap seam stitch.

The lap seam stitch is used on many knitted garments, such as men's briefs, sweatshirts and sweatpants. These garments have a thick binding at each end that generally runs perpendicular to the direction of the lap seam and frequently contains an elastic material.

When sewing on or off the machine with these types of garments a peak in the binding may develop. When peaking occurs, the binding of the left ply does not align with the binding of the right ply in a straight line. Instead, either a gap or an angle in the binding is observed. Peaking causes the material to be susceptible to tearing, is unsightly, and is uncomfortable to the wearer. Accordingly, peaking in the lap seaming stitch is not acceptable.

One attempt at solving the peaking problem has been to lay the left ply down flat and trim the right ply only. But this procedure reveals the raw edge of the untrimmed left ply because it is not sewn inside the width of the stitch.

The invention solves the peaking problem and provides for trimming of both the left and the right ply. Thus, when sewing a lap seam stitch on two plies with bindings, the bindings align with one another when sewing on and off the garment. In addition, because both the left and the right ply are trimmed, a clean seam showing no raw edge is produced.

SUMMARY OF THE INVENTION

The invention provides a device for sewing together two plies of cloth with a lap seam comprising a cloth guide that is disposed between a plurality of reciprocating needles and the front of a cutting knife. The guiding portion of the cloth guide extends substantially between the needles and the front edge of the cutting knife to control the plies of cloth.

For a lap seaming operation where the right ply is on the top, the cloth guide is located to the left of the area where the plies are laid down and sewn. For a lap seaming operation where the left ply is on the top, the cloth guide is located to the right of the area where the plies are laid down and sewn.

In another embodiment, the present invention provides a second cloth guide located to the left of the area where the plies are laid down and sewn. The second cloth guide provides a full lap of material when sewing a lap seam where the left ply is to be laid on top of the right ply.

DETAILED DESCRIPTION OF THE DRAWINGS AND PREFERRED EMBODIMENTS

Figure 1:
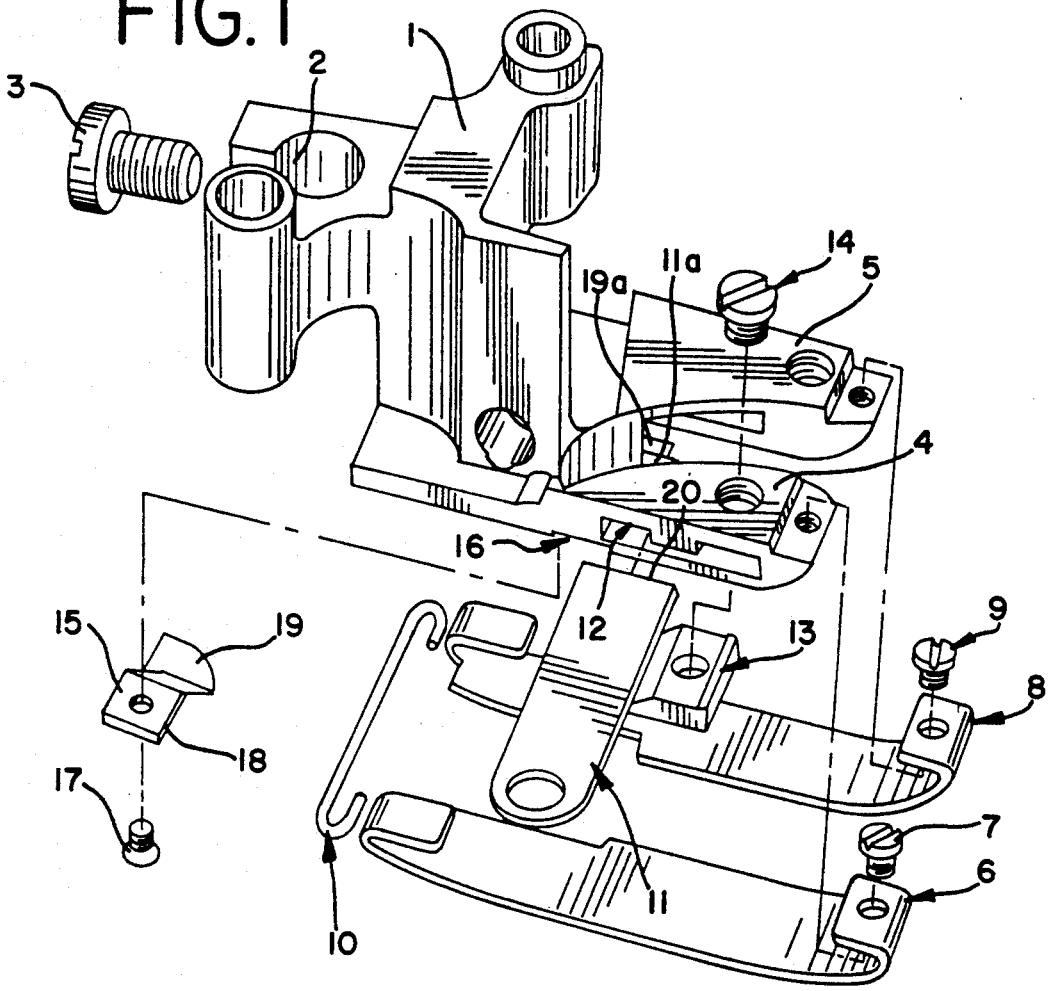
FIG. 1 depicts a top perspective of a presser foot and cloth guide containing one embodiment of the invention.

FIG. 1 illustrates a presser foot 1 which is attached to a sewing machine body by a presser bar (not shown) that is secured in an aperture 2 by a screw 3. The presser foot 1 has at the bottom a front left prong 4 and a front right prong 5, defining an open ended front section. Each of the prongs bears a shoe: a left shoe 6 is attached to the left prong 4 by a screw 7, and a right shoe 8 is attached to the right prong 5 by a screw 9. The left and right foot shoes 6, 8 are fastened together at the rear by a shoe holding wire 10.

A stationary cutting knife 11, having a cutting edge 20, fits into a knife slot 12 and is secured by a stationary knife clamp 13 and a screw 14. A cloth guide 15 fits into a cloth guide slot 16 and is fastened by a screw 17. The cloth guide 15 has a support portion 18 and a guide portion 19 or guide finger. When attached to the presser foot 1, the cloth guide portion 19 is below the cutting knife 11. For sewing operations where the left ply is on the bottom and the right ply is on the top, the cloth guide portion 19 extends from the front left prong 4 toward the open ended space. In the embodiment illustrated, the cloth guide portion 19 extends from the front left prong 4 a greater distance than the cutting edge 20 of the stationary knife 11, and the front of the stationary knife 11 extends towards the front of the presser foot 1 a greater distance than the cloth guide portion 19. The cloth guide 19 and stationary knife 11 are shown assembled in FIG. 1 by reference numerals 19*a* and 11*a*, respectively, and in a front perspective in FIG. 2.

The assembled presser foot 1 may contain other conventional parts such as a cover thread assembly, a chip guard assembly, and a presser foot yielding section assembly. The presser foot 1 may also contain additional cloth guides if necessary.

Figure 2:
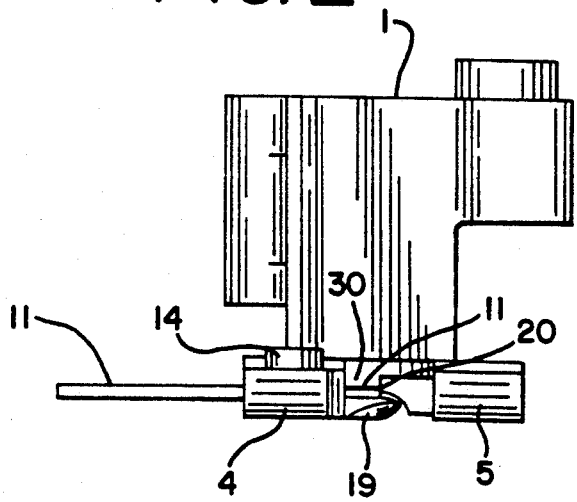
FIG. 2 depicts a front perspective of a presser foot and cloth guide containing one embodiment of the invention.

It is preferred that the cloth guide and the knife be supported by the presser foot as illustrated in FIGS. 1 and 2. However, the cutting knife and the cloth guide may be supported in any manner which carries out the invention.

Figure 3A:
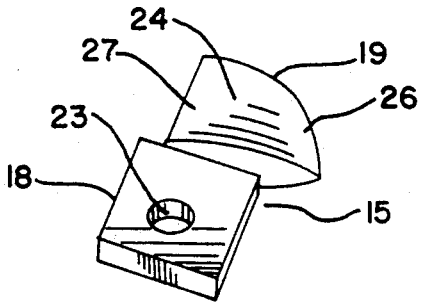
FIG. 3 depicts two perspectives of a cloth guide embodiment of the invention.
Figure 3B:
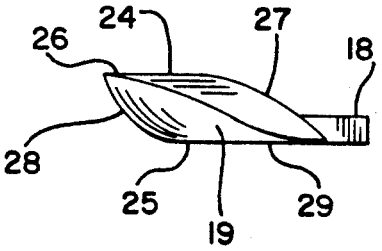

According to FIG. 3, the support portion 18 of the cloth guide 15 is generally flat and rectangular and has an aperture 23 for the fastening screw 17 (shown in FIG. 1). FIG. 3*b* illustrates a side perspective of the cloth guide 15 as viewed from the front right prong 5 when assembled. The cloth guide portion 19 has a top 24 and a bottom 25. The front portion 26 of the top 24 is substantially flat and the back portion 27 of the top 24 slopes downward. The shape of the bottom 25 approximates the bottom shape of a spoon. The front portion 28 of the bottom 25 slopes downward and the back portion 29 of the bottom 25 is substantially flat.

The bottom 25 guides a first ply of cloth downward below the guide portion 19, while the top 24 guides a second ply of cloth upward over the guide portion 19, separating the first ply from the second ply, and then downward when the second ply contacts the inside back portion 30 of the presser foot 1. For the embodiment illustrated, the first ply of cloth would be the left ply and the second ply would be the right ply.

Figure 4:
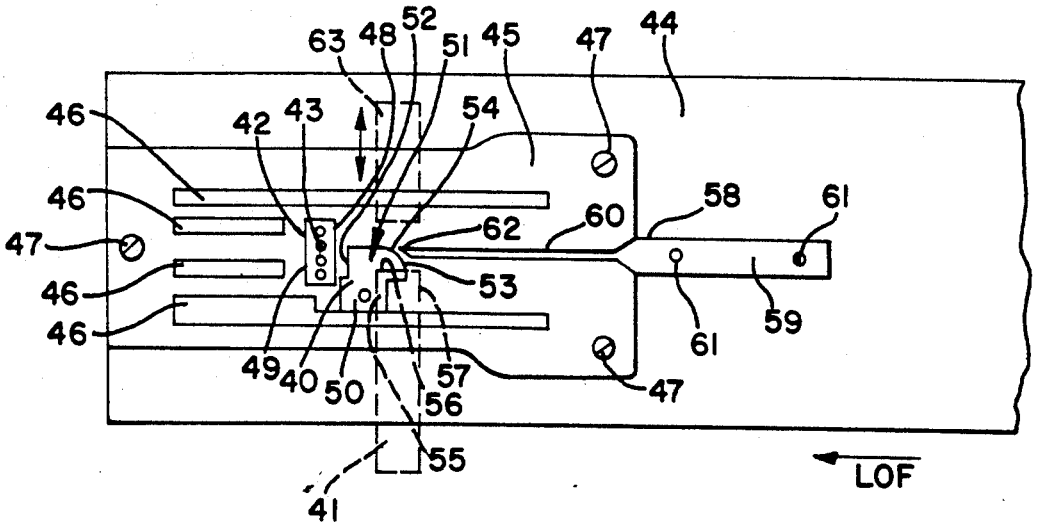
FIG. 4 depicts a top perspective of another embodiment of the invention.

FIG. 4 is a top perspective of a sewing arm assembly illustrating the position of a cloth guide 40, a cutting knife 41 and a needle opening 42 for receiving a plurality of needles 43 arranged in a plane. A sewing arm 44 bears a throat plate 45 containing conventional openings 46 and the needle opening 42. The throat plate 45 is set into the sewing arm 44 and is fastened by screws 47. The needle opening 42 has a front edge 48 and a back edge 49.

The cloth guide 40 has a support portion 50 and a guide portion 51 which has a rear edge 52 and a front edge 53 having a curve 54. The cutting knife 41 has a rear 55, a cutting edge 56 and a front 57. A lap finger 58 having a base 59 and a finger 60 is set into the sewing arm 44 and attached by screws 61. The finger 60 is contoured and terminates in a point 62 which is shown disposed near the curve 54 on the guide portion 51 of the cloth guide 40.

The cloth guiding portion 51 substantially traverses the distance between the needles 43 and the front 57 of the stationary cutting knife 41. Preferably, to avoid interference with the sewing operation, the rear edge 52 of the cloth guiding portion 51 does not extend into the needle opening 42.

Table 1 provides measurements for the arrangement depicted in FIG. 4 and compares the invention, designated as Lap Device 1, to a prior art cloth guide, designated as Lap Device 2, used with a 36200 class flat seamer sewing machine, available from Union Special Corporation (part no. 36230 R, Ref. No. 21 on page 10 of Union Special Catalog No. T118H, Class 36200 High Speed Cylinder Flatseamer Machines, April, 1980).

TABLE 1

| Lap Device | (a) Front of knife to needle C/L | (b) Length of cloth guide* | (c) C/L of needle to rear cloth guide edge | (d) Front of knife to front cloth guide edge | (e) % (b)/(a) × 100 |
|---|---|---|---|---|---|
| 1 | .590 | .377 | .123 | .090 | 63.8% |
| 2 | .590 | .192 | .178 | .220 | 32.5% |

*measured at widest functional part

Table 1 illustrates that the length of the cloth guide of the invention is almost twice as long as the cloth guide used previously, and will therefore be in contact with the plies for twice the time if other variables such as the sewing speed and the number of stitches per inch remain the same.

To provide maximum control of the plies, the length of the cloth guide measured at its widest functional part (distance (b)) extends substantially between the front of the cutting knife and the sewing needle centerline (distance (a)). The distance that the cloth guide extends is limited by interference of the cloth guide with the cutting operation by the knife and laying down of the plies at the front, and the sewing operation of the needles at the rear. There must also be sufficient distance between the rear of the cloth guide and the needles to allow the two plies to be brought together before sewing the stitch. These distances will generally vary upon the thickness and type of cloth that is being sewn. In the embodiment illustrated in Table 1, the cloth guide of the invention covers about 63.8% of the total length between the front of the knife to the center line (C/L) of the needles to accommodate a thick binding material. In comparison, the prior art cloth guide covers only 32.5% of the total length.

In the invention, two plies are trimmed and laid down upon one another in a lap area before presentation to the sewing needles. In the embodiment illustrated in FIG. 4, a lap area is defined by the needles 43 at the rear and the front of the cutting knife 57 at the front. The lap area has a left and a right side generally defined by the space needed to perform the sewing operation. The cloth guiding portion 51, or finger, substantially traverses the distance between the rear and the front of the lap area.

In this embodiment, the right ply is laid down over the left ply. A left ply of cloth and a right ply of cloth are positioned near the base 59 of the lap finger 58. The abutting edges of the plies are folded upward in preparation for trimming by the stationary cutting knife 41 and a moveable cutting knife 63, which reciprocates toward and away from the stationary cutting knife 41 at a perpendicular angle to the line of feed (LOF) of the plies. After the plies are trimmed the left ply is guided below the bottom of the guide portion 51 of the cloth guide 40 and the right ply is guided over the top of the guide portion 51 of the cloth guide 40. The finger 60 is sufficiently sized to allow the plies to pass, and assists in guiding the right ply by preventing it from being carried downward with the left ply. The guiding portion 51 keeps the left and right plies separated until just before reaching the front edge 48 of the needle opening 42. As the right ply is forced against the inside back portion 30 of presser foot 1 (see FIG. 2), the right ply is guided downward by the top back portion of the cloth guide 51 (see FIG. 3) and is laid on top of the left ply for presentation to the needles 43 for sewing.

In this manner, the invention produces a flat lapped seam and eliminates peaking of the stitch when sewing on and off the garment. Without being limited to theory, it is believed that the peaking problem is solved by controlling the left and right plies as soon as possible after trimming and as long as possible before presenting them to the needles for sewing. This is accomplished by extending the guide portion of the cloth guide substantially between the sewing needles and the front edge of the cutting portion of the stationary trim knife. The plies are controlled by the cloth guide immediately after cutting and are laid down upon one another with assistance from the cloth guide immediately before sewing. This control prevents the plies from being pulled apart or bunched up.

The invention is especially suited for sewing plies having a thick binding at one end. Thus, when sewing men's briefs, the invention eliminates peaking on the leg binding, which is thicker than the cloth ply, when sewing on or off the garment. The invention produces a flat lapped seam on the crotch and both sides of the stitch are trimmed and folded.

The invention is preferably used with a 36200 class flat seamer sewing machine, available from Union Special Corporation. The 36200 class machine can produce a 607 stitch, which is formed with four needle threads, one looper thread and one cover thread, and an Lsa-1 type seam.

Figure 5:
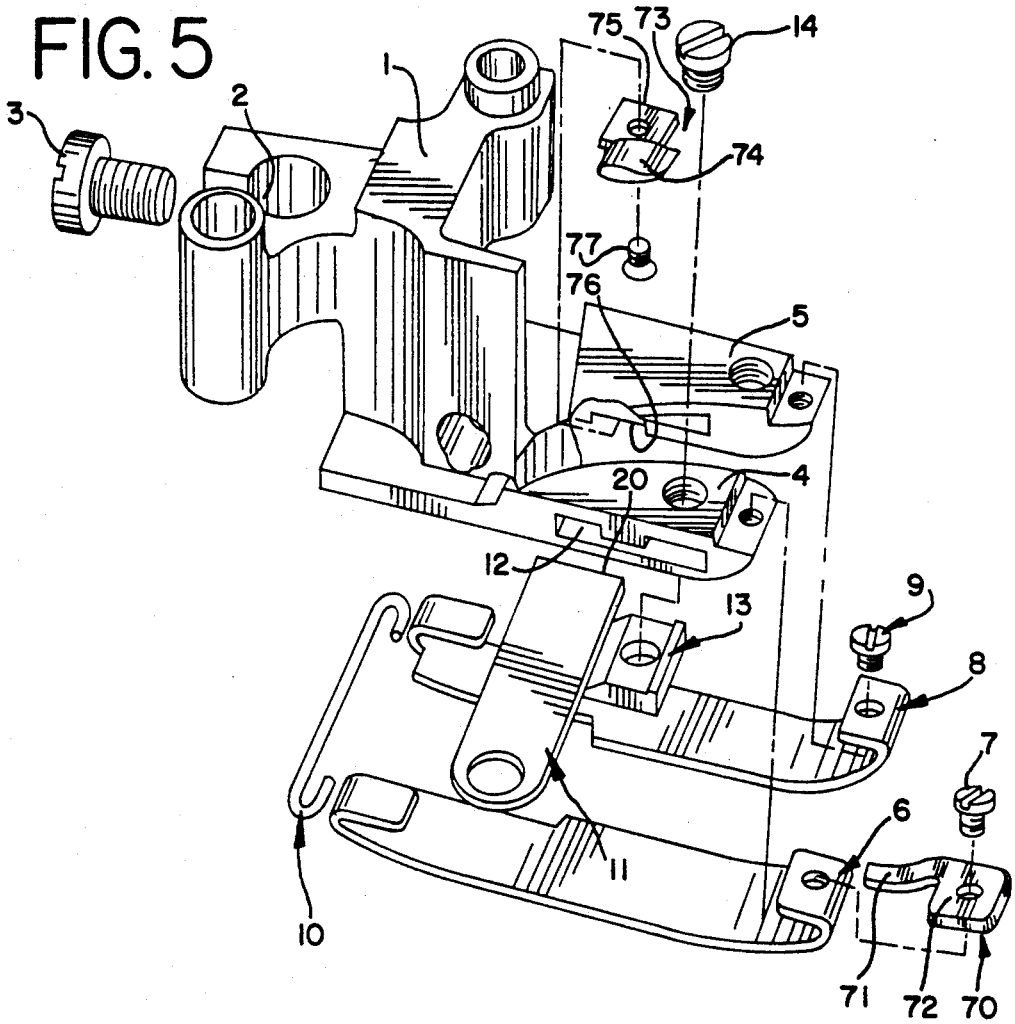
FIG. 5 depicts a top perspective of another embodiment of the invention showing a presser foot having two cloth guides.
Figure 6:
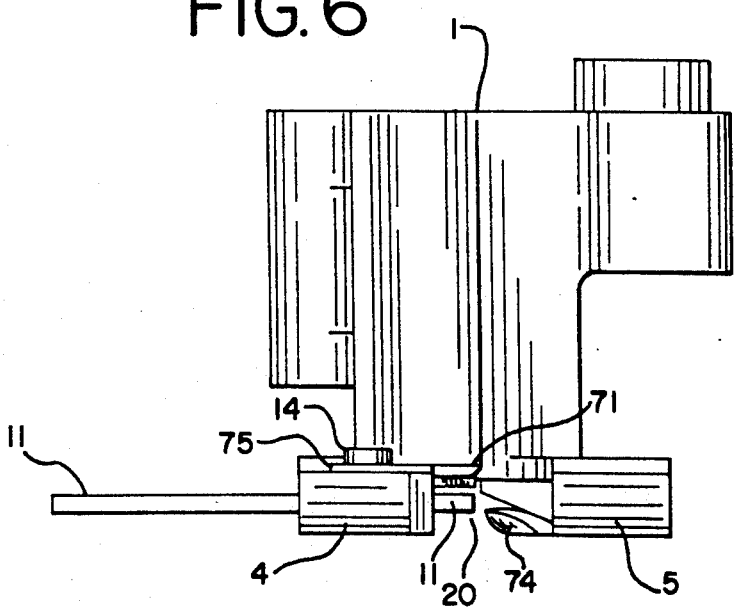
FIG. 6 depicts a front perspective of another embodiment of the invention showing a presser foot having two cloth guides.

The invention is normally used to lie the right ply down over the left ply. However, as shown in the embodiment illustrated in FIGS. 5 and 6, a lap seam may be sewn where the left ply is laid down over the right ply. FIG. 5 illustrates a first cloth guide 73 (which is similar in function to cloth guide 19 in FIG. 2) that contains a finger portion 74 and a support portion 75. The first cloth guide 73 is affixed to the bottom of the front right prong 5 in slot 76 by screw 77. The first cloth guide 73 functions to control the laying down operation as long as possible as previously described for cloth guide 19 in the discussion of FIGS. 1 to 4.

A second cloth guide 70 having a finger portion 71 and a support portion 72 is affixed to the top of the front left prong 4 of the presser foot by screw 7 and is forward of the stationary cutting knife 11. The second cloth guide 70 guides the left ply on top of the right ply for presentation to the sewing needles.

In an embodiment where the first cloth guide 73 is not necessary to the lap seaming operation, the cloth guide 70 may be used alone to assure that the left ply is laid down upon the right ply for the lap seaming operation.

The foregoing describes preferred embodiments of the invention and is not to be construed as a limitation of the invention which is set forth in the claims.

I claim:

1. A presser foot for use in a lap seam stitching operation comprising:

an open ended front section defined by a front left prong and a front right prong and a back section having a needle opening;

a stationary cutting knife supported by said front left prong and being disposed within said open ended front section;

a first cloth guide supported by said front left prong and being disposed forward of and above said stationary knife; and a second cloth guide supported by said front right prong and being disposed within said open end behind a front edge of the stationary cutting knife.

2. The presser foot of claim 1 wherein said second cloth guide has a finger disposed within said open end substantially between said needle opening and a front edge of the stationary cutting knife.

* * * * *